United States Patent [19]

Roberson

[11] 4,074,546

[45] Feb. 21, 1978

[54] FLUID TREATING SYSTEM FOR TEXTILE FIBERS

[75] Inventor: James H. Roberson, Greenville, S.C.

[73] Assignee: Crompton & Knowles Corporation, New York, N.Y.

[21] Appl. No.: 744,673

[22] Filed: Nov. 24, 1976

[51] Int. Cl.[2] ..... D06B 1/02

[52] U.S. Cl. ..... 68/205 R; 19/66 R; 68/DIG. 1

[58] Field of Search ..... 68/205 R, 62, 181 R, 68/184, DIG. 1; 8/156; 19/66 R, 66 CC, 66 T, 156.4; 118/325, 326; 134/166 R, 167 R, 168 R, 169 R; 285/177

[56] References Cited

U.S. PATENT DOCUMENTS

| | | | |
|---|---|---|---|
| 3,320,641 | 5/1967 | Bryan | 19/156.4 X |
| 3,881,222 | 5/1975 | Roberson | 19/66 R |

FOREIGN PATENT DOCUMENTS

| | | | |
|---|---|---|---|
| 158,519 | 10/1963 | U.S.S.R. | 19/66 R |

*Primary Examiner*—Philip R. Coe

[57] ABSTRACT

Fluid treatment apparatus for textile fibrous material comprising a duct, a portion of which is enlarged to form a fiber treating chamber which includes an outlet opening, an inlet opening and a central passageway which extends between the openings and which has a surface which extends from a first point on the periphery of the inlet opening to a second point on the periphery of the outlet opening and extends no further from the longitudinal axis of the central passageway than the first point so that the surface is wiped by fiber entering the central passageway to prevent the accumulation of moisture near the inlet opening.

14 Claims, 7 Drawing Figures

FLUID TREATING SYSTEM FOR TEXTILE FIBERS

BACKGROUND OF THE INVENTION

This invention relates generally to apparatus for the treatment or conditioning of unspun textile fibers to change their physical characteristics, especially their surface properties. The invention is particularly directed to apparatus of the type which includes a duct for conveying the fibers to be treated. The fibers are conveyed through the duct by pneumatic means which creates an airstream within the duct. Treatment of the fibers occurs in a portion of the duct which is enlarged and identified as a fiber treatment chamber. This chamber is generally horizontally disposed and includes an inlet opening, an enlarged central passageway and an outlet opening. The inlet and outlet openings connect the central passageway to the remainder of the duct. The central passageway has a greater cross-section than either the inlet or outlet openings in respective planes which are transverse to the longitudinal axis of the central passageway. The centers of the inlet and outlet openings are located on the longitudinal axis of the central passageway so that the outer boundaries of the passageway extend below and above the lower and upper extremities, respectively, of the inlet opening.

The increased size of the fluid treatment chamber increases the flow area through the chamber so that the fibrous mass which enters the chamber from the duct expands and travels through the treatment chamber at a slower rate. Spraying nozzles are located at the top of the chamber adjacent the inlet opening for spraying fiber treating fluid within the central passageway generally toward the bottom of the chamber. The expansion of the fibrous mass as it enters the passageway creates increased exposure of the fibers for treatment and the decreased velocity ensures longer exposure to the spraying process. The treating fluid which is used may be for a wide variety of purposes. Examples of fiber treatment may be tinting, moisturizing, addition of antistatic compositions, etc.

A major disadvantage of conventional fiber treatment apparatus has been that the fluid which is used to treat the fibers has a tendency to collect on the bottom surface of the treatment chamber. Loose fibers accumulate in the fluid and adhere to it. After a period of time, the fibers in the bottom of the chamber accumulate into a clumpy mass which finally grows to the extent of interfering with the flow of fibers through the chamber and may even be carried out of the chamber into the duct to block it.

SUMMARY OF THE INVENTION

A principle object of the present invention is to eliminate the above disadvantage of conventional fiber treatment chambers by constructing a chamber, the longitudinal axis of which is offset with respect to the longitudinal axis of the remaining portions of the duct. The inlet opening from the duct into the central passageway of the chamber is located so that the surface toward which the spray is directed is aligned with a first point on the periphery of the inlet opening. This surface may continue from this first point along a plane which is parallel to the longitudinal axis of the central passageway or it may converge toward the axis to a second point on the periphery of the outlet opening. In the latter case, the inlet and outlet openings are offset so that the second point is closer to the longitudinal axis of the passageway than the first point and the surface may be straight or curved. It is also preferred that the longitudinal axis of the passageway be generally horizontal, but the invention is still effective if the axis is not horizontal. This novel construction of the treatment chamber causes the fibers which enter the treatment chamber to come into immediate contact with the surface toward which the spray is directed and continuously wipe this surface and thereby continuously pick up treating fluid therefrom. This surface is kept dry and buildup of clumps of fibrous material is prevented.

BRIEF DESCRIPTION OF THE DRAWINGS

The invention will be more clearly understood upon reading of the following specification together with the accompanying drawings in which.

PRIOR ART

Figure 7:
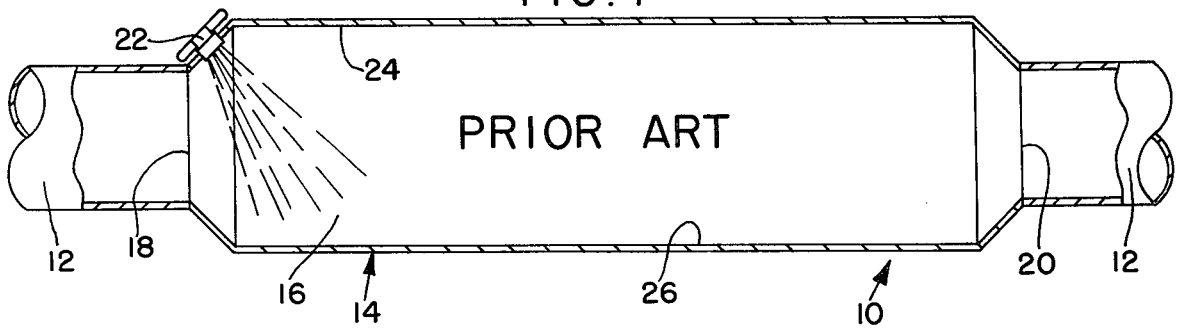
FIG. 7 is a diagrammatic longitudinal section of a prior art fluid treatment apparatus.

Referring particularly to FIG. 7, there is shown fiber treating apparatus of the prior art generally indicated by the reference numeral 10. Apparatus 10 comprises a duct 12, a portion of which is enlarged to form a fluid treatment chamber generally indicated by the reference numeral 14 and includes a central passageway 16 and inlet and outlet openings 18 and 20, respectively, which connect the central passageway 16 to the remaining portions of the duct 12. Spray nozzles 22 are located adjacent the inlet opening 18 for spraying treating fluid into central passageway 16. Pneumatic means, not shown, are effective to create an airstream within duct 12 and passageway 16 for conveying fibers through duct 12 so that they pass through central passageway 16 from inlet opening 18 to outlet opening 20. The textile fibers to be treated enter the central passageway 16 through inlet opening 18 at which point they are treated by fluid from spray nozzles 22 after which they pass from central passageway 16 into the remaining portion of duct 12 through outlet opening 20. The treated fibers are then conveyed to further processing equipment at a point further downstream. As shown in FIG. 7, the fluid treatment chambers of the prior art are constructed so that the center of the inlet opening is located on the central longitudinal axis of the central passageway 16. In this construction, the upper surface 24 of chamber 14 is located above the upper extremity of opening 18 and the lower surface 26 of chamber 14 is located below the lower extremity of inlet opening 18. The spray nozzles are directed generally toward lower surface 26 and there is a tendency for fluid from spray nozzles 22 to collect on the surface 26. Some of the fibers which enter inlet opening 18 drift into this fluid and accumulate to form a matted wad of saturated textile fibers which builds up to a point of interfering with the normal flow of fibers through central passageway 16 and may even become dislodged and pass into the duct 12 through outlet opening 20 to clog the duct.

DETAILED DESCRIPTION OF THE PREFERRED EMBODIMENT

Figure 1:
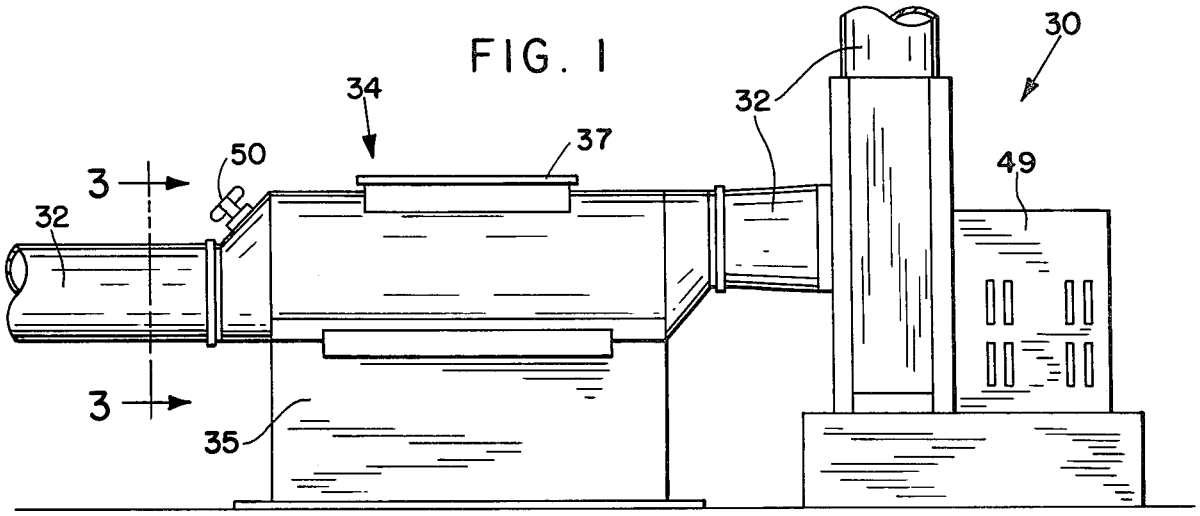
FIG. 1 is a front elevation of the fluid treatment apparatus of the present invention.
Figure 2:
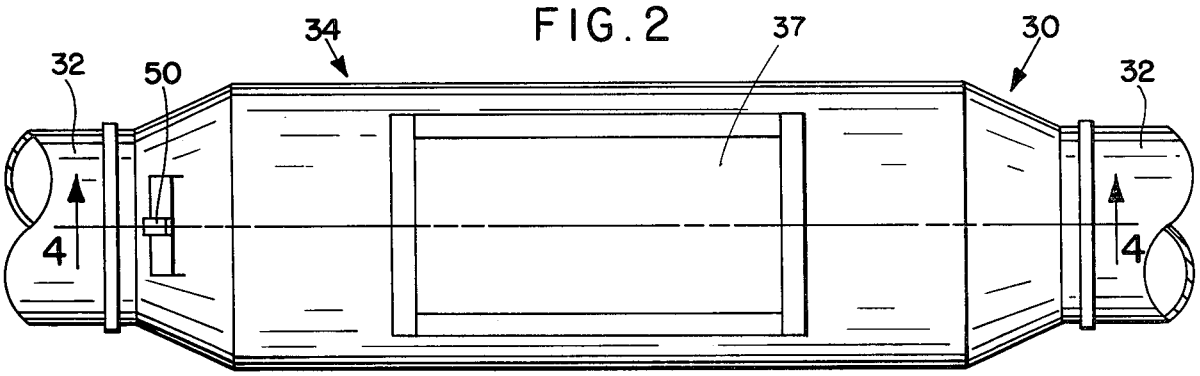
FIG. 2 is a plan view thereof.
Figure 3:
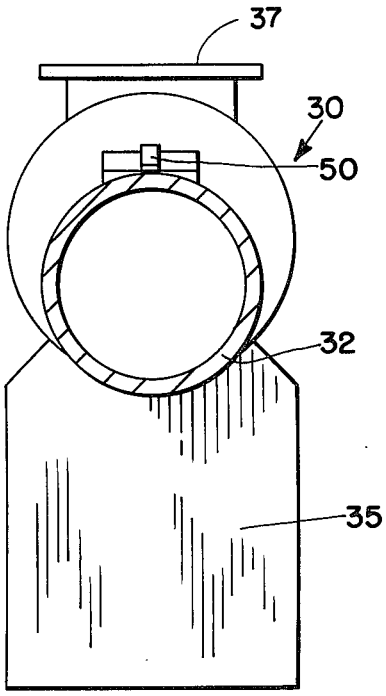
FIG. 3 is a vertical cross-section taken along line 3—3 in FIG. 1 and looking in the direction of the arrows.

The preferred apparatus of the present invention is generally indicated by the reference numeral 30, see particularly FIGS. 1, 2, and 3, and comprises a duct 32 which includes an enlarged portion forming a fiber treating chamber generally indicated by the reference numeral 34 which is supported on a base 35, an observation windo 37 is located at the top of the chamber.

Figure 4:
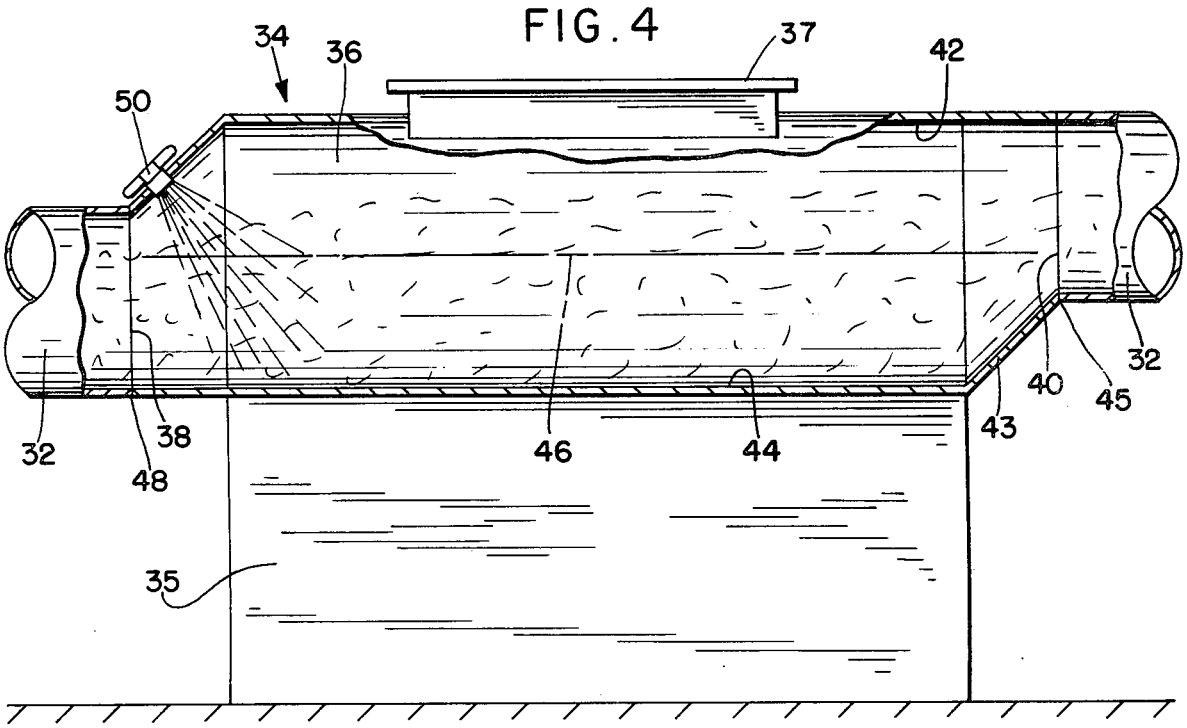
FIG. 4 is a vertical cross-section taken along line 4—4 in FIG. 2 and looking in the direction of the arrows.

Referring particularly to FIG. 4, fiber treating chamber 34 comprises a central passageway 36 and inlet and outlet openings 38 and 40, respectively, which connect central passageway 36 to duct 32. Central passageway 36 has an upper surface 42 and a lower surface 44. The center of inlet opening 38 is located below the central longitudinal axis 46 of central passageway 36 so that the lowest point 48 of opening 38 is no higher than the lowest point of lower surface 44. In the preferred embodiment, point 48 and the portion of surface 44 which is contiguous with point 48 are equidistant from axis 46. In this preferred embodiment, outlet opening 40 is located at a point considerably above lower surface 44 so that surface 44 converges at 43 toward axis 46 and intersects a point 45 on the periphery of outlet opening 40. A fan 49 (see FIG. 1) is operably connected to duct 32 on the outlet side of fiber treating chamber 34 and is effective to create an airstream within the duct 32 and the chamber 34. The airstream is effective to convey fibers along the duct and through central passageway 36 so that fibers pass from inlet opening 38 to outlet opening 40. Spray nozzles 50 are located adjacent inlet opening 38 for spraying treating fluid into central passageway 36 toward lower surface 44. As the textile fibers enter the central passageway through inlet opening 38, the fibrous mass expands and is treated by the spray from nozzles 50. Any treating fluid which reaches the bottom surface 44 of passageway 36 is constantly wiped by the mass of fibers moving through the passageway so that fluid is never allowed to accumulate on surface 44. The treated fibers then pass through outlet opening 40 into the remaining portion of duct 32 and are further conveyed along duct 32 to further fiber processing apparatus at a point downstream of the duct.

Figure 5:
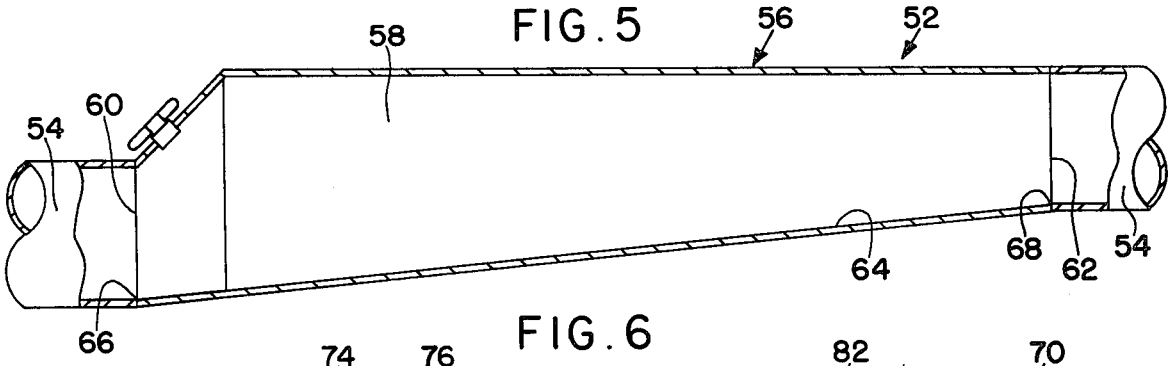
FIG. 5 is a diagrammatic longitudinal section of a first modification.

Referring to FIG. 5, there is shown a first modification generally indicated by the reference numeral 52 and comprises a duct 54 which includes an enlarged portion forming a fiber treating chamber generally indicated by the reference numeral 56. Chamber 56 comprises a central passageway 58 and inlet and outlet openings 60 and 62, respectively, which connect central passageway 58 to duct 54. The bottom surface of central passageway 58 is indicated at 64 and extends from the lowest point 66 of inlet opening 60 on an incline to the lowest point 68 of outlet opening 62. Surface 64 can be straight, as shown in FIG. 5.

Figure 6:
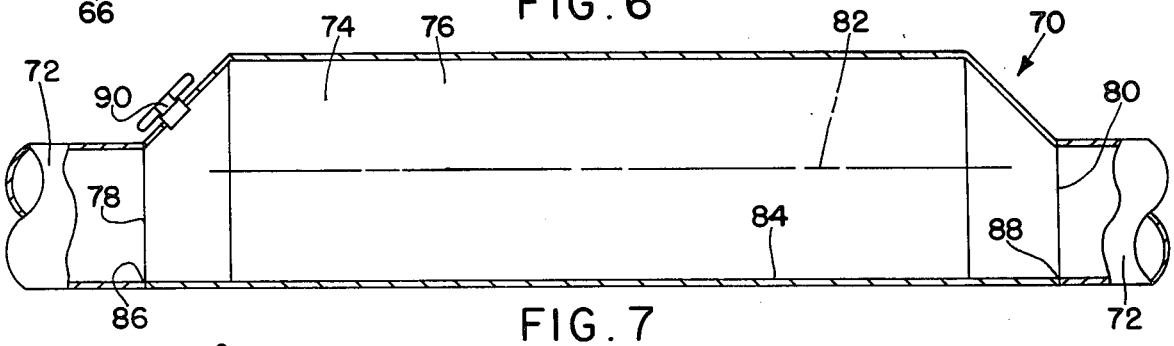
FIG. 6 is a diagrammatic longitudinal section of a second modification.

Referring to FIG. 6 there is shown a second modification generally indicated by the reference numeral 70 which comprises a duct 72 having an enlarged portion which forms a fiber treatment chamber 74 which includes a central passageway 76 and inlet and outlet openings 78 and 80, respectively, which connect central passageway 76 to duct 72. The centers of inlet and outlet openings 78 and 80, respectively, are both located below the central longitudinal axis 82 of central passageway 76 so that the lower surface 84 of central passageway 76 extends from the lowest point 86 of inlet opening 78 to the lowest point 88 of outlet opening 80. Spray nozzles 90 are located adjacent inlet opening 78 for spraying treating fluid into central passageway 76 generally toward surface 84 for treating fibers which enter central passageway 76 from duct 72 through inlet opening 78. As in the case of previously described embodiments, the treated fibers from central passageway 76 pass into duct 72 through outlet opening 80 and then proceed to further fiber processing apparatus downstream of the duct.

I claim:

1. A fluid treatment apparatus for textile fibrous material comprising:
   a. a pneumatic conveyor duct for textile fibrous material;
   b. means for creating an air flow within said duct;
   c. a fiber treating chamber forming part of said duct and which includes an outlet opening, an inlet opening and a central passageway which extends between said openings, said inlet opening having a smaller cross section than said central passageway in respective planes which are transverse to the longitudinal axis of said central passageway, said central passageway having a surface which extends from a first point on the periphery of said inlet opening to a second point on the periphery of said outlet opening and extends no further from the longitudinal axis of said central passageway than said first point; whereby said surface is wiped by fiber entering said passageway; and
   d. means located adjacent said inlet opening for spraying fiber treating fluid within said central passageway toward said surface, whereby fibrous material entering said passageway through said inlet opening is treated by said fluid.

2. The fluid treatment apparatus as set forth in claim 1 wherein a substantial length of the portion of said surface which is contiguous with said first point lies in the same plane as said first point.

3. The fluid treatment apparatus as set forth in claim 2 wherein said plane is parallel with said longitudinal axis.

4. The fluid treatment apparatus as set forth in claim 1 wherein said second point is closer to said longitudinal axis than said first point.

5. The fluid treatment apparatus as set forth in claim 4 wherein said surface extends from said first point to said second point in a straight line.

6. The fluid treatment apparatus as set forth in claim 1 wherein said surface and said first and second points are equidistant from said longitudinal axis.

7. The fluid treatment apparatus as set forth in claim 1 wherein said longitudinal axis is generally horizontal.

8. The fluid treatment apparatus as set forth in claim 1 wherein said inlet and outlet openings are annular and said central passageway is tubular.

9. A fluid treatment apparatus for textile fibrous material comprising:
   a. a fiber treating chamber having an outlet opening, an inlet opening and a central passageway which extends generally horizontally between said openings, said inlet opening having a smaller cross section than said central passageway in respective planes which are transverse to the longitudinal axis of said central passageway, the lowest point of said inlet opening being at least as low as the lowest point of said central passageway, whereby said surface is wiped by fiber entering said passageway;

b. means for creating an air flow in said passageway from said inlet opening to said outlet opening for conveying fibrous materials to said inlet opening, for advancing said fibrous material from said inlet opening to said outlet opening, and conveying said fibrous material away from said outlet opening; and c. means located adjacent said inlet opening for spraying fiber treating fluid within said passageway, whereby fibrous material entering said chamber through said inlet opening is treated by said fluid.

10. The fluid treatment apparatus as set forth in claim 9 wherein the lowermost point of said inlet opening and said chamber are at the same level.

11. A fluid treatment apparatus for textile fibrous material comprising:

a. an inlet duct;

b. an outlet duct;

c. a fiber treatment chamber which extends generally between said inlet and outlet ducts and which has a larger cross section than said ducts in a plane which is transverse to the longitudinal axis of the chamber, said chamber including an outlet opening connecting said chamber to said outlet duct, an inlet opening connecting said chamber to said inlet duct and a central passageway extending between said openings, said central passageway having a surface which extends from a first point on the periphery of said inlet opening to a second point on the periphery of said outlet opening and extends no further from the longitudinal axis of said central passageway than said first point, whereby said surface is wiped by fiber entering said passageway;

d. means for creating an air flow through said ducts and said chamber for conveying fibrous material from said inlet duct through said chamber and away from said chamber through said outlet duct; and e. means located adjacent said inlet opening for spraying fiber treating fluid within said central passageway toward said surface, whereby fibrous material entering said chamber through said inlet opening is treated by said fluid.

12. The fluid treatment apparatus as set forth in claim 11 wherein a substantial length of the portion of said surface which is contiguous with said first point lies in the same plane as said first point.

13. The fluid treatment apparatus as set forth in claim 12 wherein said plane is parallel with said longitudinal axis.

14. The fluid treatment apparatus as set forth in claim 11 wherein said second point is closer to said longitudinal axis than said first point.

* * * * *

UNITED STATES PATENT AND TRADEMARK OFFICE

CERTIFICATE OF CORRECTION

PATENT NO. : 4,074,546

DATED : February 21, 1978

INVENTOR(S) : James H. Roberson

It is certified that error appears in the above-identified patent and that said Letters Patent are hereby corrected as shown below:

Column 3, line 58, after "FIG. 5" and before the period (.) insert --or it can be curved if desired--.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*